US006459052B2

(12) United States Patent
Kajio et al.

(10) Patent No.: US 6,459,052 B2
(45) Date of Patent: Oct. 1, 2002

(54) KEY UNIT AND SWITCH BODY AND DOOR SWITCH USING THE SAME

(75) Inventors: Hiroyuki Kajio; Takashi Niwa; Hidemitsu Takenaka; Yasuo Isa, all of Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 09/851,413

(22) Filed: May 9, 2001

(30) Foreign Application Priority Data

May 12, 2000 (JP) ..... 2000-139597

(51) Int. Cl.[7] ..... H01H 27/00
(52) U.S. Cl. ..... 200/43.04; 200/61.62
(58) Field of Search ..... 200/17 R, 43.01, 200/43.04, 43.07, 43.09, 43.11, 61.62, 61.64, 61.7, 61.71, 61.73, 61.76, 334

(56) References Cited

U.S. PATENT DOCUMENTS 3,924,085 A * 12/1975 Stone ..... 200/61.62
5,662,212 A * 9/1997 Wecke et al. ..... 200/43.04
5,744,767 A * 4/1998 Wecke et al. ..... 200/17 R
5,918,731 A * 7/1999 Wecke et al. ..... 200/329
6,268,574 B1 * 7/2001 Edens ..... 200/43.04

* cited by examiner

*Primary Examiner*—Michael Friedhofer
(74) *Attorney, Agent, or Firm*—Foley & Lardner

(57) ABSTRACT

A door switch disclosed includes a switch body and a key unit which are attached to a structure and a door, respectively. The switch body is provided with a door key insertion hole and a switch contact. The key unit has a door key and a door key drive mechanism in its unit case. The door key drive mechanism retreats the door key into the unit case when the door is opened and protrudes it out from the unit case when the door is closed, to thereby insert the door key into the door key insertion hole in the switch body, thus turning ON the switch contact.

18 Claims, 7 Drawing Sheets

PRIOR ART

PRIOR ART

KEY UNIT AND SWITCH BODY AND DOOR SWITCH USING THE SAME

FIELD OF THE INVENTION

The present invention relates to a door switch for turning ON/OFF a contact as interlocked with the door opening and closing action and, more particularly to, a door switch used for a door provided at a doorway of a guard such as a protection fence or wall installed so as to surround a variety of machines.

BACKGROUND OF THE INVENTION

A variety of machines such as machine tools, semiconductor manufacturing equipment and food processing machines are typically surrounded by a guard such as a protection fence or wall. The operator is prevented from inadvertently coming in contact with those machines in operation by the guard. A doorway of such a guard is provided with a door for permitting the operator to enter for inspection and repair of the machines.

A door switch is equipped to such a door for turning OFF the contact in interlocked with the door opening and closing action to thereby cut off power for those machines.

Accordingly, when the operator opens the door, the machines are stopped in operation. Then the operator can enter the guard safely for inspection and repair thereof.

A prior art door switch will be described with reference to FIGS. 6 and 7. A guard is provided with a door 3. The door 3 can be opened and closed in an arrow direction between an opened position indicated by a solid line and a closed position indicated by a two-dots-and-dash line.

The door switch comprises a switch body 2 and a door key 7. The switch body 2 includes a built-in switch contact for turning ON/OFF power for the machine and also has a door key insertion hole 5.

The switch body 2 is attached to the guard 1 with its door key insertion hole 5 as oriented toward a door 3. The door key 7 is provided to the door 3 in such a manner that it can be inserted into the door key insertion hole 5 when the door 3 is opened or closed.

When the door 3 is closed with the door key 7 as inserted into the door key insertion hole 5, the switch contact in the switch body 2 is in a power application state for the machines, in which they are in operation.

When the door 3 is opened by the operator, the door key 7 is pulled out of the door key insertion hole 5. Then, the switch contact in the switch body 2 is switched to a state for cutting off power for the machines to stop them in operation.

Such a door key 7 is always protruded toward the door key insertion hole 5 irrespective of whether the door 3 is opened or closed. The operator is liable to come in contact with the door key 7 when he opens the door 3 to come into or go out of the guard 1.

SUMMARY OF THE INVENTION

Accordingly, it is a main object of the present invention to provide a door switch that its switch contact is turned OFF when the door is opened and also that its door key is not protruded out the inside of the door.

The above and other objects, advantages, and features of the invention will be more apparent from the following description.

A door switch according to the invention operates interlocked with the door opening and closing action and comprises a switch body and a key unit used as separated from the switch body, wherein the switch body includes a switch case having a door key insertion hole therein and a switch contact built in the switch case and the key unit includes a unit case, a door key which is provided in the unit case in such a manner that it can be protruded out and retreated into it, for switching the switch contact when inserted into the door key insertion hole, and a door key drive mechanism for, when pressed from the outside, protruding the door key from the unit case and, when released from the pressing, retreating the door key into the unit case.

In the invention, preferably, the switch body is attached on one side of the door or a structure to which that door is mounted and the key unit, on the other side thereof.

BRIEF DESCRIPTION OF THE DRAWINGS

These and other objects as well as advantages of the invention will become clear by the following description of preferred embodiments of the invention with reference to the accompanying drawings, wherein.

In all these figures, like components are indicated by the same numerals.

DETAILED DESCRIPTION OF THE PREFERRED EMBODIMENTS

Figure 1:
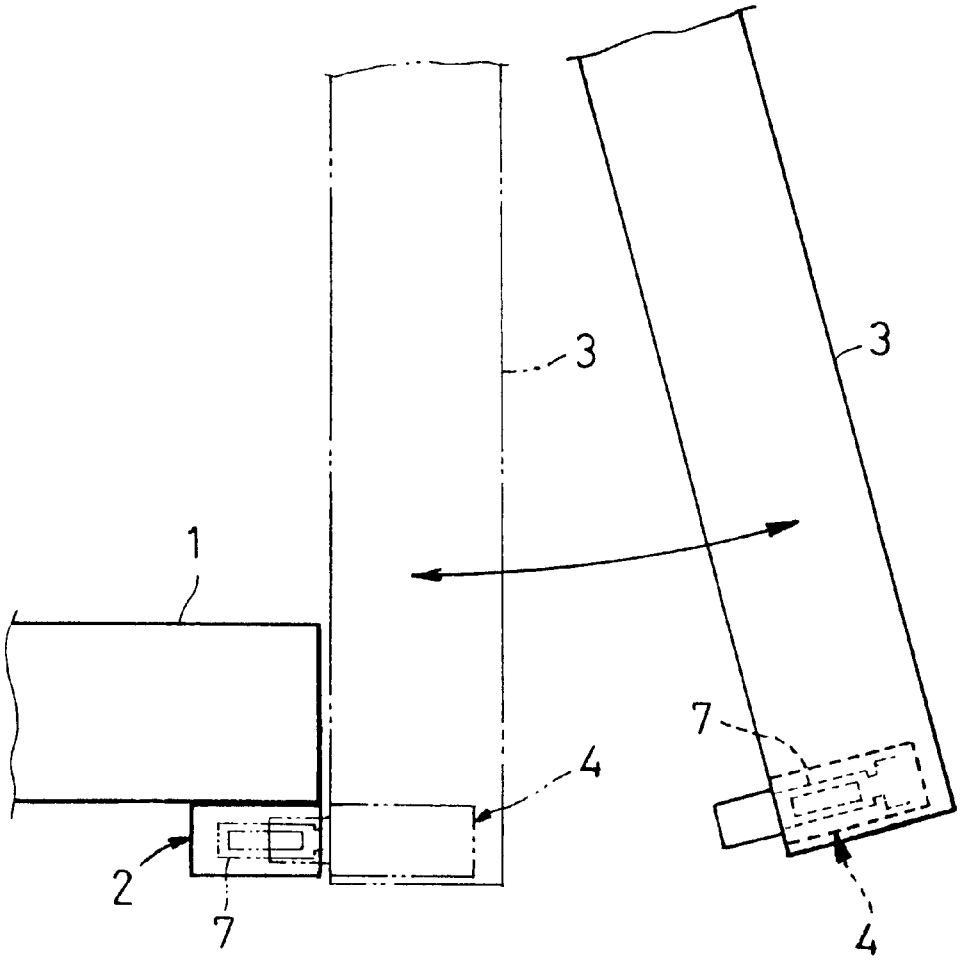
FIG. 1 is a plan view for showing a guard and an important part of a door switch according to a preferred embodiment of the invention attached to a door of the guard.

Referring now to FIG. 1, a guard 1, which is one example of a fixed structure, is installed around machine tools, semiconductor manufacturing equipment, and other types of machines. The guard 1 is shown in the drawings only at its wall which constitutes the surroundings of a doorway for those machines.

A door 3 is mounted at a doorway of the guard 1 so as to be opened and closed in an arrow direction between an opened position indicated by a solid line and a closed position indicated by a two-dots-and-dash line.

A door switch A comprises a switch body 2 and a key unit. The switch body 2 is attached to an outer edge of the guard 1, has a door key insertion hole 5 therein and includes a contact mechanism, not shown, for turning ON/OFF the power of the machines. The key unit 4 is attached to a playing end side of the door 3 and includes a door key 7.

When the door 3 is closed, a door key 7 is inserted into the key insertion hole 5 in the switch body 2, to thereby turn ON the contact mechanism, thus supplying power for the machines to place them in operation.

When the door 3 is opened by the operator for inspection and repair of the machines, the door key 7 is pulled out from the key insertion hole 5 in the switch body 2, to thereby turn OFF the contact mechanism of the switch body 2, thus cutting off the power for the machines to stop them in operation.

Meanwhile, the door key 7 is retreated and housed in the key unit 4 by a door key drive mechanism described later. Since this mechanism thus prevents the door key 7 from protruding from the inside of the door 3 when the door 3 is opened, the operator can avoid coming in contact with the door key 7 inadvertently.

Figure 2:
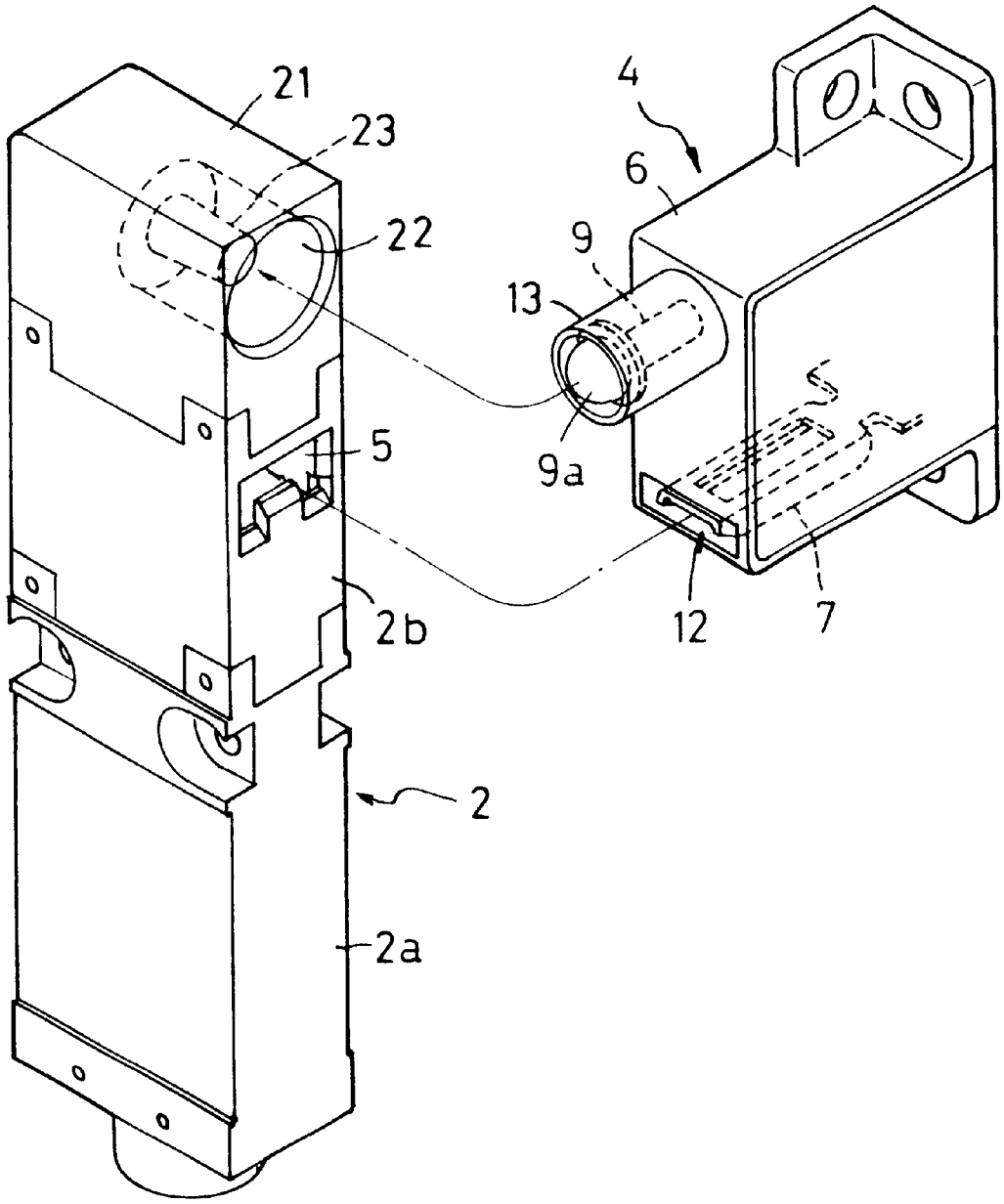
FIG. 2 is an expanded perspective view for showing the door switch of FIG. 1.
Figure 3:
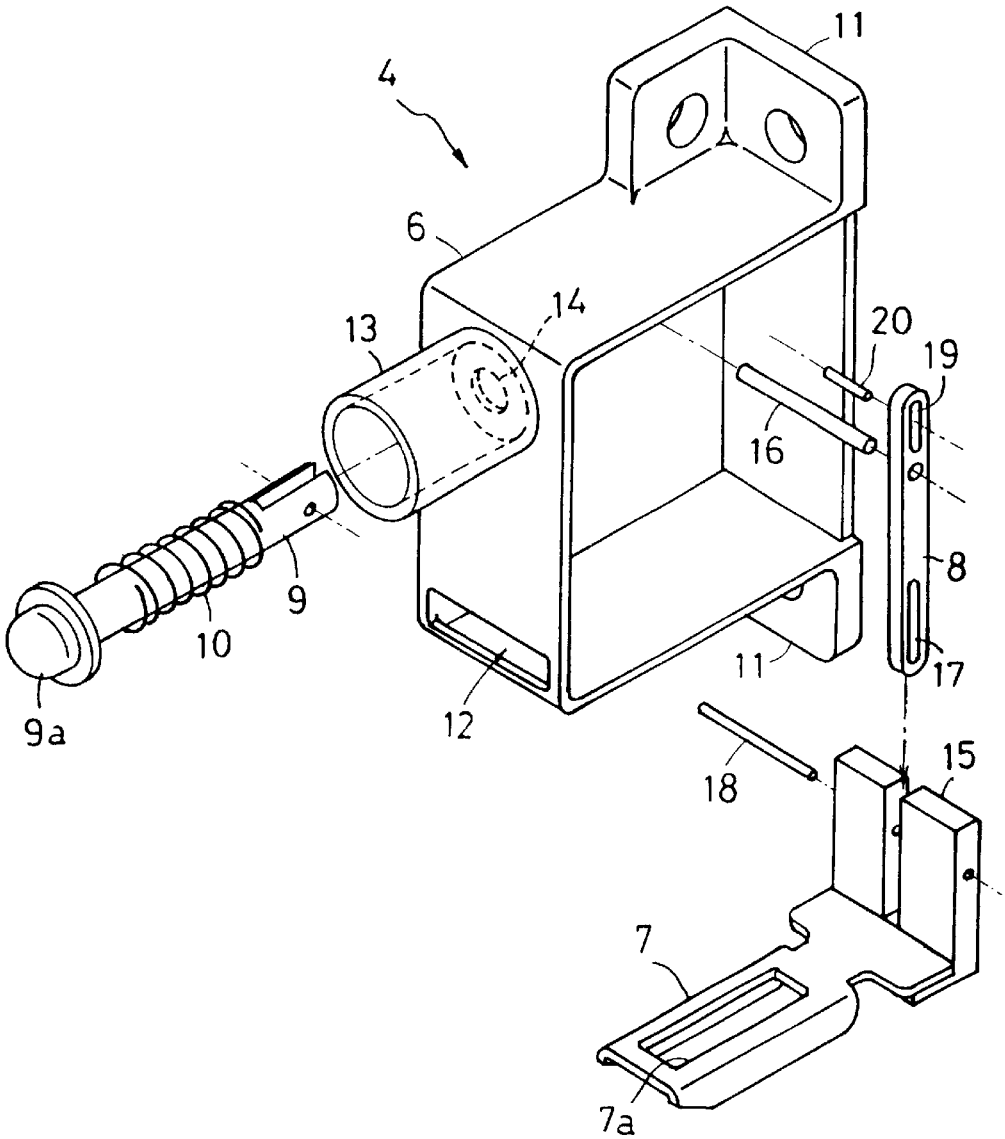
FIG. 3 is an expanded perspective view for showing a key unit as exploded of the door switch of FIG. 2.

As shown in FIGS. 2 and 3, the switch body 2 comprises a body case 2*a* and an operation case 2*b* linked therewith on it.

The body case 2*a* has a built-in contact mechanism, not shown, comprised of a switch contact and a plunger for turning ON/OFF this switch contact.

The operation case 2*b* has a built-in contact drive mechanism, not shown, comprised of, e.g., a cam for turning ON/OFF the switch contact by driving the plunger of the contact mechanism.

In the front of the operation case 2*b* is formed the key insertion hole 5 into which the door key 7 is inserted.

When the door key 7 is inserted into the key insertion hole 5, the cam constituting the contact drive mechanism in the operation case 2*b* is driven in rotation. Then, the plunger in the body case 2*a* is driven to thereby turn ON the switch contact. This in turn supplies power for the machines and operates them.

If the door key 7 is pulled out from the door insertion hole 5, on the other hand, the above-mentioned cam in the operation case 2*b* is rotary-driven in a reverse direction. Then, the plunger in the body case 2*a* is driven in a direction opposite to the above-mentioned one to thereby turn OFF the switch contact. This cuts off power for the machines and stops them in operation.

The above-mentioned contact mechanism utilized here is equipped with a forcedly contact opening mechanism for forcedly opening the switch contact. With such a contact mechanism, even if welding should occur at the switch contact when power is being supplied, the cam constituting the contact drive mechanism is forcedly rotary-driven in the reverse direction to thereby forcedly open the switch contact, thus preferably cutting off power securely.

The key unit 4 houses the door key 7 in the unit case 6 and is equipped with a rocking link 8, a push rod 9, and a coil spring 10.

The unit case 6 is made of a resin and box-shaped with its side opened.

The unit case 6 has at the rear end thereof an attaching portion 11 for being attached to the door 3, an opening 12 through which the door key 7 is retreated and protruded in its lower part of the front thereof, a boss 13 for guiding the push rod 9 at its upper part of the front thereof, and a rod mounting hole 14 in the bottom of the boss 13.

The door key 7 is formed by blanking a hard metal sheet such as a stainless steel sheet and by pressing it.

The door key 7 has a rectangular hole 7*a* therein through which it is engaged with the above-mentioned contact drive mechanism built in the operation case 2*b* of the switch body 2, at the base of which is fixed a linkage member 15 by caulking.

The push rod 9 has a large-diameter head 9*a* with a spring receiving flange at its front end and is inserted from the front side into the rod mounting hole 14 in the unit case 6 in a state where it is provided with the coil spring 10.

The rocking link 8 is rotatably supported at its intermediate site by the unit case 6 via a support shaft 16. The lower part of the rocking link 8 is interlocked and linked with the linkage member 1 of the door key 7 via an elongated hole 17 and a linkage pin 18. The upper part of the rocking link 8 is interlocked and linked with the inner end of the push rod 9 via an elongated hole 19 and a linkage pin 20.

When the push rod 9 is moved forward or backward, the rocking link 8 is rocked around the support shaft 16. Then, the door key 7 linked with the lower part of the rocking link 8 is moved backward and forward to be protruded out and retreated into the opening 12 in the unit case 6.

A distance between the upper side linkage pin 20 and the support shaft 16 is set smaller than a distance between the lower side linkage pin 18 and the support shaft 16. This setting expands retreating and advancing distances of the push rod 9, which are in turn converted into advancing and retreating distances of the door key 7.

In the invention, as mentioned above, the push rod 9, the coil spring 10, the rocking link 8, etc. make up in combination the door key drive mechanism for protruding the door key 7 from the unit case 6 when a pressure is applied from the outside and retreating it into the unit case 6 when the pressure is deactivated.

In this door key drive mechanism, the push rod 9 constitutes a displacing mechanism such that it is retreated and displaced when pressed by the switch body 2 and advanced and displaced when released from the pressing.

In the door key drive mechanism, also, the rocking link 8 is linked between the door key 7 and the push rod 9 for constituting a interlocking mechanism such that it advances the door key 7 out from the unit case 6 as interlocked with retreating of the push rod 9 and retreating the door key 7 into the unit case 6 as interlocked with advancing of the push rod 9.

Figure 4A:
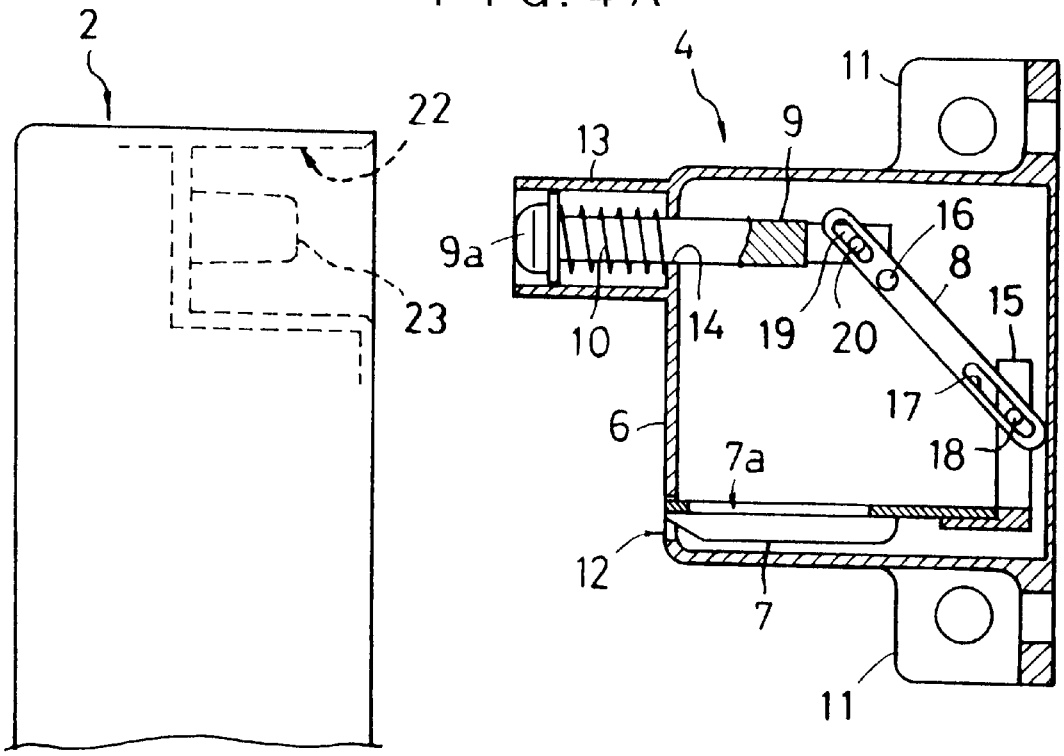
FIG. 4A is a vertical cross-sectional side view for showing a state of the door switch of FIG. 1 where a door is opened.

In the case of the key unit 4 having the above-mentioned configuration, as shown in FIG. 4A, normally the push rod 9 is protruded forward by the elastic energizing force of the coil spring 10. The rocking link 8 is rocked until its lower end butts against the inner surface of the rear wall of the case. Accordingly, the door key 7 is held where it is entirely retreated in the opening 12.

The key unit 4 is buried in and mounted on the playing end side of the door 3 in such a manner that the front of the unit case 6 thereof may be roughly flush with the inner surface of the door 3.

As shown in FIG. 2, the switch body 2 is linked with a key operation portion 21 at its upper part. In the front of the key operation portion 21 is formed a recess 22 having a size permitting the insertion of the boss 13 provided as protruded out the front of the key unit 4. In the recess 22 is provided a protrusion 23 which can butt against the large-diameter head 9*a* of the push rod 9.

Therefore, when the door 3 is open as indicated by the solid line in FIG. 1, as shown in FIG. 4A, in the key unit the door key 7 is retreated in the key unit 4 by the elastic energizing force of the coil spring 10, so that the operator does not come in contact with the door key 7. In this state, the switch contact is in an OFF state in the contact mechanism of the body case 2*a* to thereby cut off power for the machines, which are stopped in operation.

When the door 3 is closed, on the other hand, the boss 13 in the key unit 4 is inserted into the recess 22 of the key operation portion 21. Accordingly, the door key 7 is held at the above-mentioned retreated position until the protrusion 23 in the recess 22 butts against the large-diameter head 9*a* of the push rod 9.

Figure 4B:
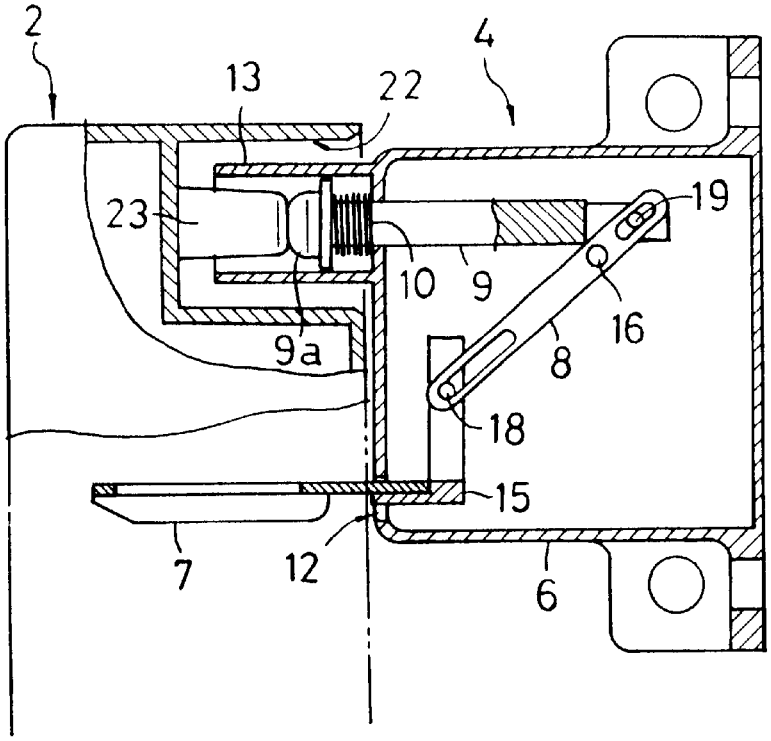
FIG. 4B is a vertical cross-sectional side view for showing a state of the door switch where the door is closed as against FIG. 4A.

In an interval from a time when the protrusion 23 butts against the large-diameter head 9*a* of the push rod 9 to a time when the door 3 is closed completely, the protrusion 23 pushes in and displaces the large-diameter head 9*a* of the push rod 9 with respect to the coil spring 10. As a result, as shown in FIG. 4B, the door key 7 is largely displaced forward by the rocking link 8 and inserted into the key insertion hole 5 in the switch body.

When the door key 7 is thus inserted into the above-mentioned door key insertion hole 5 completely, the contact drive mechanism of the operation case 2*b* drives the contact mechanism of the body case 2*a* to thereby turn ON the switch contact. Then, the machines enter a power-applied state and start operation.

In this case, in an interval from a time immediately before the door 3 is closed to a time when it is closed completely, the door key 7 is protruded out the key unit 4 in a small stroke, so that it is inserted into the key insertion hole 5 almost linearly.

Therefore, the door key 7 can be smoothly inserted into and pulled out from the door key insertion hole 5 even if it is not arranged at the playing end of the door 3 which has a large opening radius in particular, thus being relaxed in restrictions on its installation position. By this feature, the door key 7 can be arranged, for example, near the base end where the operator of the door 3 hardly comes in contact with it.

In the invention, the boss 13 protruded out the unit case 6 may be made of hard rubber with an appropriate elasticity so that it may be prevented from being damaged when it comes in contact with other objects.

Figure 5A:
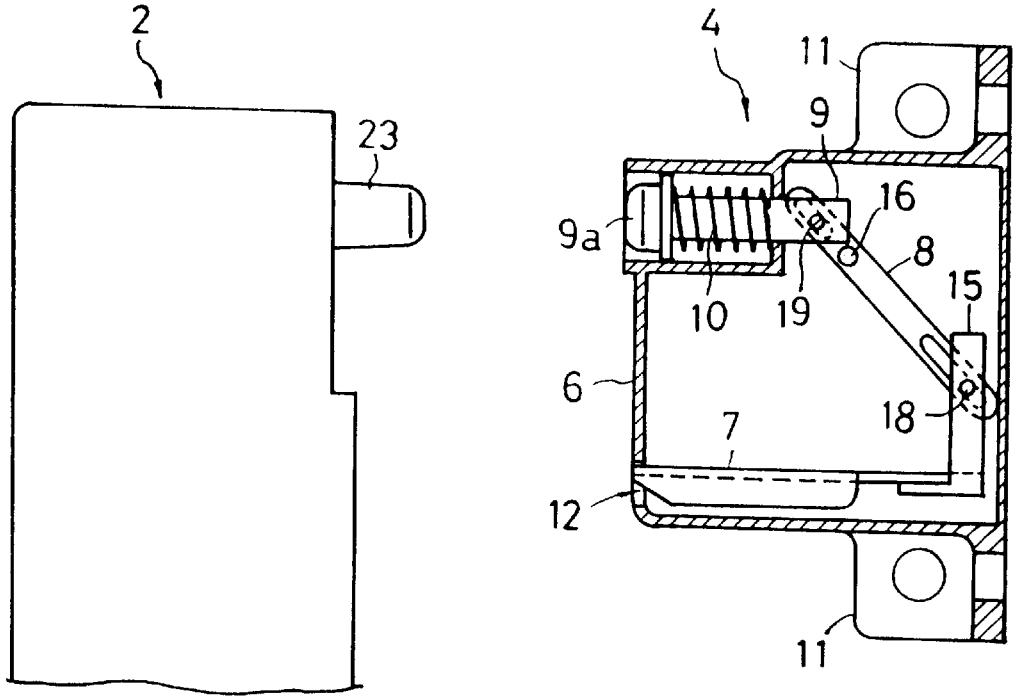
FIG. 5A is a vertical cross-sectional side view for showing a state of a door switch according to another embodiment of the invention where the door is opened.
Figure 5B:
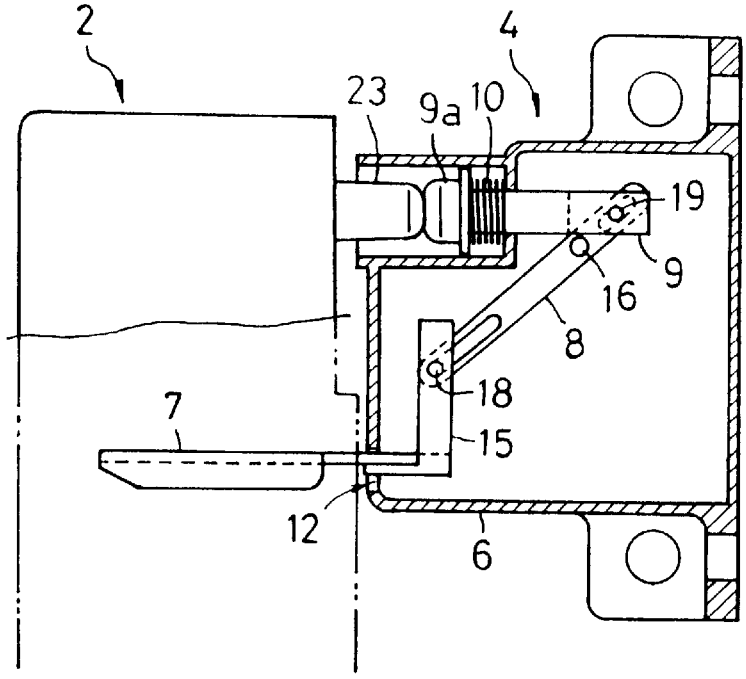
FIG. 5B is a vertical cross-sectional side view for showing a state of the door switch where the door is closed as against FIG. 5A.
Figure 6:
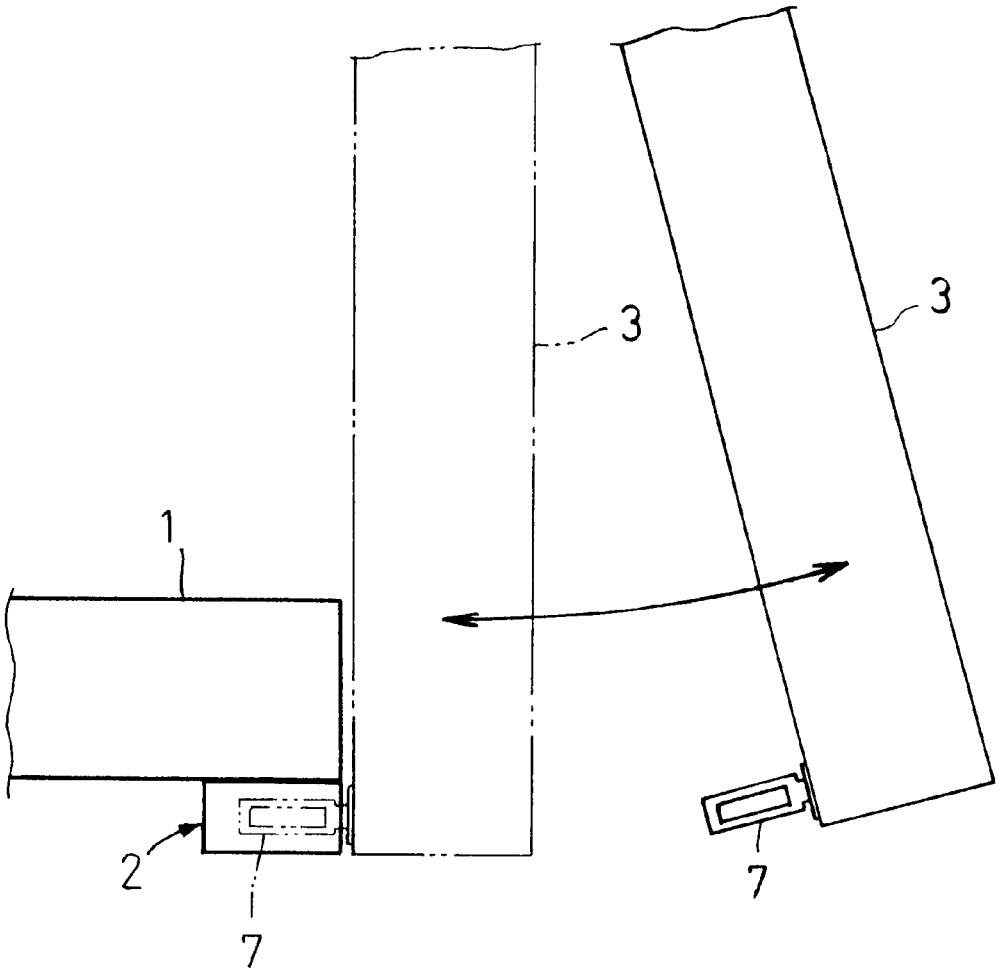
FIG. 6 is a plan view for showing the guard and an important part of a prior art door switch attached to the door of the guard.
Figure 7:
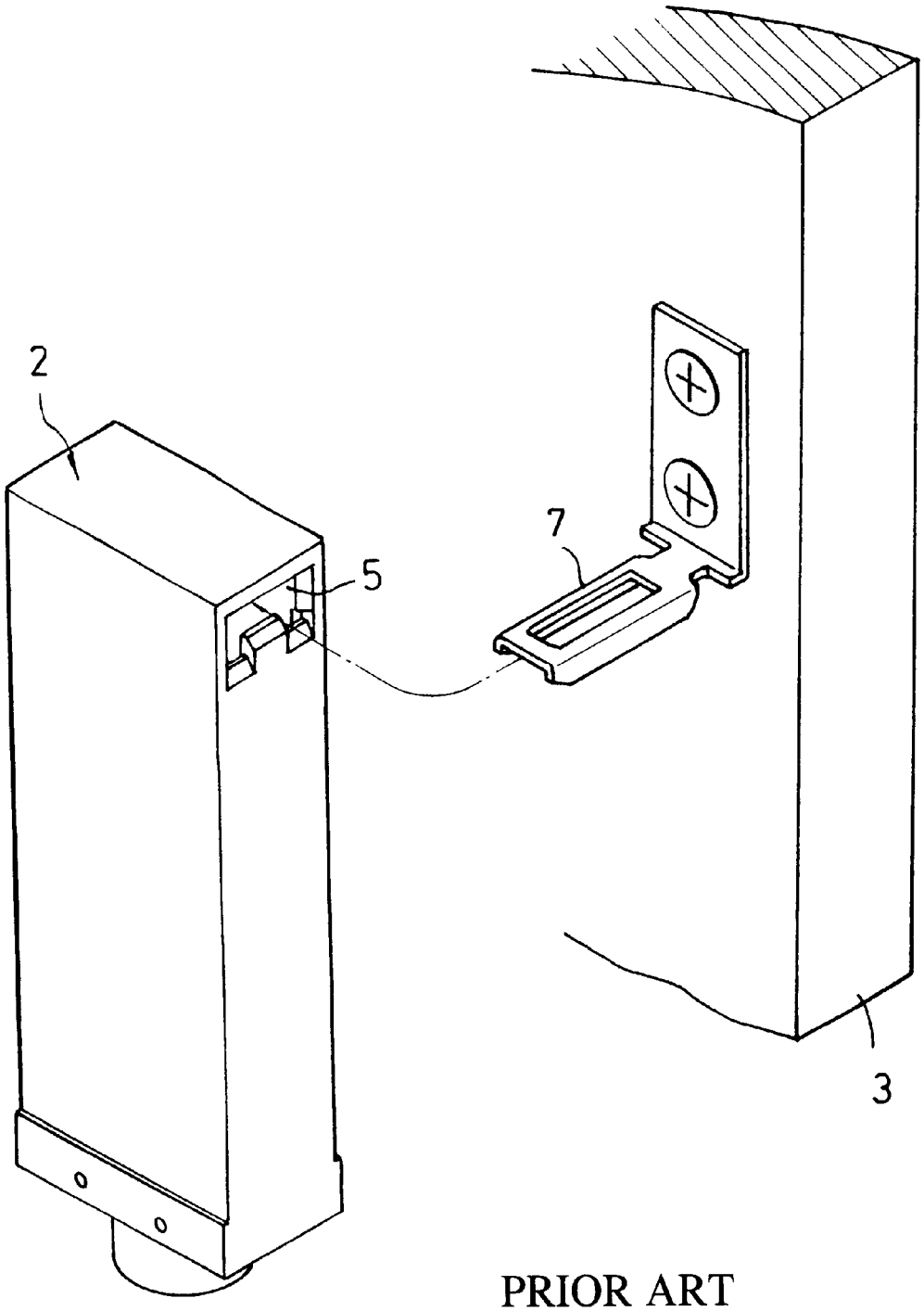
FIG. 7 is an expanded perspective view for showing the door switch of FIG. 6.

In the invention, as shown in FIGS. 5A and 5B, the push rod 9 may be provided as buried in the unit case 6. In this case, when the door is open, not only the door key 7 but also the push rod 9 may not come in contact with other objects.

In this case, the protrusion 23 may be made of an elastic material such as hard rubber in case it may protrude to the switch body 2 or the guard 1 to come in contact with the operator or any other object.

In this invention, the door key 7 may have a snap action construction, whereby when the push rod 9 is pressed and displaced even slightly by the protrusion 23, the door key 7 may be instantaneously protruded out from the key unit.

In this invention, although the above-mentioned door key drive mechanism has been described as a mechanical one, it may be such an electrical mechanism that a proximity sensor detects that the door 3 has been completely or mostly closed, and in response to that detection the door key 7 is protruded out from the key unit 4.

This invention can be applied not only to the rocking opening/closing type but also to sliding opening/closing type of the door 3.

In this invention, the key unit 4 may be provided on the fixed side of the guard 1 etc. and the switch body 2, on the side of the door 3.

In the invention, the door 3 or the wall surface of the guard 1 may act also as at least part of the unit case 6 of the key unit 4 so that the components in the unit case 6 can be contained in the housing portion formed at the door 3 or the guard 1.

While there has been described what is at present considered to be preferred embodiments of this invention, it will be understood that various modifications may be made therein, and it is intended to cover in the appended claims all such modifications as fall within the true spirit and scope of this invention.

What is claimed is:

1. A key unit comprising:

a unit case;

a door key provided in said unit case in such a manner that said door key can be protruded out from and retreated into said unit case; and a door key drive mechanism for, when pressed from outside said unit case, protruding said door key out from said unit case and, when released from said pressing, retreating said door key into said unit case.

2. The key unit according to claim 1, wherein said unit case has an opening in a front thereof, through which said door key can be protruded out from and retreated into said unit case.

3. The key unit according to claim 1, wherein said door key drive mechanism includes:

a displacing mechanism which is retreated in displacement when pressed and advanced in displacement when released from pressing; and an interlocking mechanism linked between said door key and said displacing mechanism, for protruding said door key out from and retreating said door key into said key unit as interlocked with displacement of said displacing mechanism.

4. The key unit according to claim 3, wherein said displacing mechanism includes a guide boss provided on a front of said unit case of the key unit, a push rod housed in said guide boss, and a coil spring for energizing said push rod toward a switch body;

said push rod is retreated in said unit case when a front end side thereof is pressed by said switch body; and said interlocking mechanism is of a configuration having a rocking link for converting a retreating action of said push rod into a protruding action of said door key.

5. The key unit according to claim 4, wherein said rocking link of said interlocking mechanism has a rocking support point at such a position that expands an advancing distance of said door key rather than a retreating distance of said push rod.

6. The key unit according to claim 4, wherein said guide boss of said displacing mechanism is made of a hard elastic material.

7. A switch body equipped to a door switch interlocked with a door opening or closing action, said switch body comprising:

a body case; and an operation case linked at an upper part of said body case, and wherein said operation case has a key insertion hole for inserting a key of a key unit and also has a recess in which a protrusion is provided for pressing a push rod of said key unit.

8. A door switch interlocked with a door opening or closing action, said door switch comprising:

a switch body; and a key unit which can be separated from said switch body, wherein said switch body has a body case provided with a door key insertion hole therein and wherein said key unit comprises a unit case, a door key arranged in said unit case in such a manner that said door key can be protruded out from and retreated into the unit case, and a door key drive mechanism for, when pressed from the outside said unit case, protruding said door key out from said unit case and, when released from said pressing, retreating said door key into said unit case.

9. The door switch according to claim 8, wherein:

said switch body is attached on one side of said door or a structure to which the door is mounted;

said key unit is attached on a side of said door other than said one side, or on said structure; and said door key drive mechanism of said key unit is pressed by said switch body when said door is closed.

10. The door switch according to claim 8, wherein said door key drive mechanism includes:

a displacing mechanism which is retreated in displacement when pressed and advanced in displacement when released from pressure; and an interlocking mechanism linked between said door key and said displacing mechanism, for protruding out from or retreating said door key into said key unit as interlocked with displacement in said displacing mechanism.

11. The door switch according to claim 10, wherein:

said displacing mechanism includes a guide boss provided on a front of said unit case of the key unit, a push rod housed in said guide boss in such a manner that said push rod can be displaced forward and backward, and a coil spring for energizing said push rod forward;

said push rod is retreated in said unit case when a front end side thereof is pressed; and said interlocking mechanism includes a rocking link for converting retreating action of said push rod into an advancing action of said door key.

12. The door switch according to claim 11, wherein said rocking link of said interlocking mechanism has a rocking support point at a position that expands an advancing distance of said door key rather than a retreating distance of said push rod.

13. The door switch according to claim 11, wherein said guide boss of said displacing mechanism is made of a hard elastic material.

14. The door switch according to claim 11, wherein said switch body has a recess in which said guide boss of said displacing mechanism can be housed and a protrusion provided in said recess, for pressing said push rod.

15. The door switch according to claim 10, wherein:

said displacing mechanism includes a push rod housed in said unit case in such a manner that said push rod can be displaced forward and backward and a coil spring for energizing said push rod forward;

when a front end side of said push rod is pressed by said switch body, a rear end side of said push rod is retreated in said unit case; and said interlocking mechanism has a rocking link configuration that converts a retreating action of said push rod into an advancing action of said door key.

16. The door switch according to claim 15, wherein said switch body has a protrusion for pressing said push rod.

17. The door switch according to claim 16, wherein said protrusion of said switch body is made of a hard elastic material.

18. The door switch according to claim 8, wherein said unit case of said key unit is formed by part of said door or a structure to which said door is mounted.

* * * * *